US007635415B2

(12) United States Patent
Lestage et al.

(10) Patent No.: US 7,635,415 B2
(45) Date of Patent: Dec. 22, 2009

(54) REGENERABLE CLEANING IMPLEMENT FOR SANITIZING A SURFACE

(75) Inventors: David J. Lestage, Livermore, CA (US); Marc P. Privitera, Walnut Creek, CA (US); Gregory van Buskirk, Danville, CA (US); Scott L. Cumberland, Tracy, CA (US)

(73) Assignee: The Clorox Company, Oakland, CA (US)

( * ) Notice: Subject to any disclaimer, the term of this patent is extended or adjusted under 35 U.S.C. 154(b) by 645 days.

(21) Appl. No.: 11/427,700

(22) Filed: Jun. 29, 2006

(65) Prior Publication Data

US 2008/0000498 A1 Jan. 3, 2008

(51) Int. Cl.
*B08B 7/04* (2006.01)

(52) U.S. Cl. ..... 134/10; 134/15; 134/25.1

(58) Field of Classification Search ..... None
See application file for complete search history.

(56) References Cited

U.S. PATENT DOCUMENTS

| | | | | |
|---|---|---|---|---|
| 2,759,860 | A | 7/1956 | Pallos | |
| 3,682,690 | A | 8/1972 | Amos et al. | |
| 4,329,753 | A | 5/1982 | Weil | |
| 4,990,192 | A | 2/1991 | Pallone et al. | |
| 5,045,601 | A | 9/1991 | Capelli et al. | |
| 6,332,293 | B1 | 12/2001 | Kerr et al. | |
| 6,664,309 | B2 | 12/2003 | Svenningsen et al. | |
| 6,723,428 | B1 * | 4/2004 | Foss et al. | 428/370 |
| 7,378,479 | B2 * | 5/2008 | Tamareselvy et al. | 526/333 |
| 2005/0080157 | A1 | 4/2005 | Wagener et al. | |
| 2006/0234899 | A1 * | 10/2006 | Nekmard et al. | 510/439 |

FOREIGN PATENT DOCUMENTS

| | | | |
|---|---|---|---|
| EP | 1021204 | | 7/2000 |
| JP | 03083919 | A | 8/1989 |
| WO | WO2004/028332 | A1 | 4/2004 |
| WO | WO2005/113029 | A1 | 12/2005 |

OTHER PUBLICATIONS

K.L. DeVries and P.R. Borgmeier, Testing of Adhesives Handbook of Adhesive Technology, p. 65-75.

* cited by examiner

*Primary Examiner*—Duy-Vu N Deo
(74) *Attorney, Agent, or Firm*—David Peterson

(57) ABSTRACT

The invention relates to a reusable cleaning implement for cleaning and sanitizing a surface. More specifically, the cleaning implement is made of a tacky polymeric material and an antibacterial agent is distributed within the polymer. The adhesive and antibacterial properties of the cleaning implement are regenerated by contact with a cleansing agent.

15 Claims, 2 Drawing Sheets

Method of Cleaning and Sanitizing a Surface using the Cleaning Implement

Figure 1
Cohesive Strength and Adhesive Strength Properties

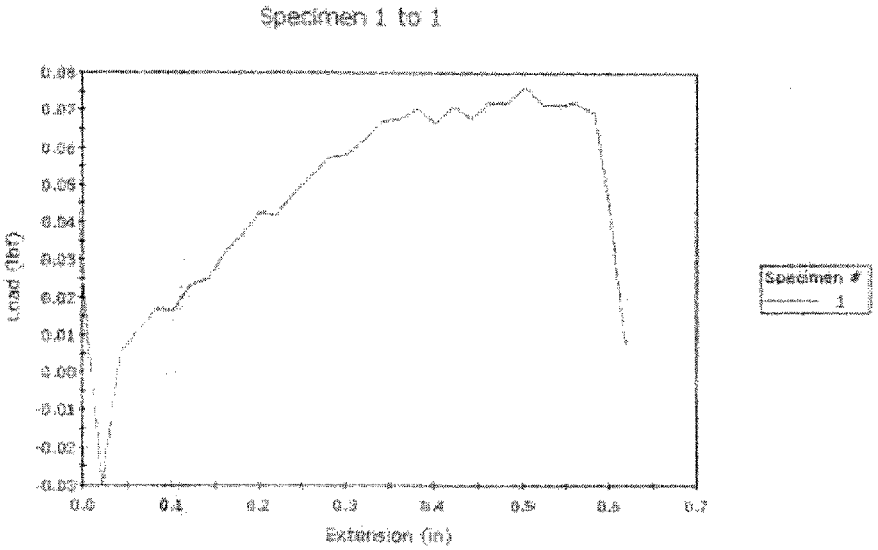

Adhesive Strength: Breaking force maximum at about 0.76 lb/f as measured on the INSTRON 5565/Q1216 according to the ASTM 2737M; bond strength 5.6; 1 in. gauge length, 12 in/min. strain rate.

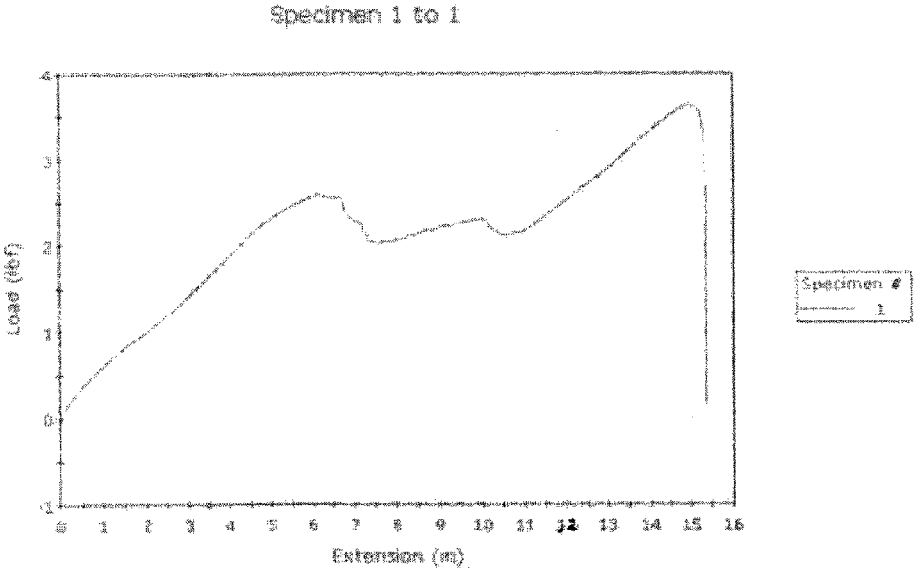

Cohesive Strength: Breaking force maximum at about 3.64 lb/f as measured on the INSTRON 5565/Q1216 according to the ASTM 2737M; bond strength 5.6; 1 in. gauge length, 12 in/min. strain rate.

Method of Cleaning and Sanitizing a Surface using the Cleaning Implement

REGENERABLE CLEANING IMPLEMENT FOR SANITIZING A SURFACE

FIELD OF THE INVENTION

The invention generally relates to a cleaning implement capable of sanitizing a surface. Specifically, the invention relates to a method and article for cleaning a surface using a cleaning implement and wherein the surface is sanitized by an antibacterial agent. More specifically, the cleaning implement is made of a tacky polymer material and the antibacterial agent is distributed within the polymer. The tacky polymer and antibacterial properties of the cleaning implement are regenerated by contact with a cleansing agent.

BACKGROUND OF THE INVENTION

Certain tacky materials, such as polymers, are water-washable and useful as cleaning implements. A tacky material, such as a polymer, can be used to clean a surface and collect debris. After cleaning is complete, the material is washed with soap and water and once the material is dry, the tackiness of the material is regenerated. Such cleaning implements are described by Amos, et al. U.S. Pat. No. 3,682,690. Tacky materials are also known for use in combination with a non-woven as a cleaning tool. O'Neill et al., WO2004028332A1, describes use of a regenerable cleaning device, wherein an adhesive polymer is coated or incorporated onto a cleaning pad. The pad can be "recharged" by spraying a new coat of adhesive material on the pad.

Tacky polymer materials are also used as adhesives and coating materials for a variety of applications, including manufacturing plaster bandages, wound coverings, catheters, hygienic packaging materials, for coating the aforementioned materials as well as for coating components of technical medical devices. For example, Svenningsen et al. in U.S. Pat. No. 6,664,309 describes bonding substrates together for use in a non-woven disposable article. Also, Capelli et al. in U.S. Pat. No. 5,045,601 describes bonding a substrate to a skin surface for use in a wound dressing. The tacky materials are often attached to wovens or non-wovens in these applications.

Incorporation of an antimicrobial active in a tacky polymer has been described for use in applications related to adhesives and coating materials. The purpose of the antimicrobial active is to inhibit the growth of microorganisms on the adhesive or coating itself and to inhibit growth between two substrates bonded together by an adhesive.

The present invention provides a novel method of cleaning and sanitizing a surface, preferably an inanimate surface. One aspect of the present invention is directed to a cleaning implement including an antibacterial agent. The cleaning implement includes a tacky polymer material used to collect debris. In yet another aspect, the tacky polymer properties and the antimicrobial properties of the cleaning implement are regenerable upon contact with a cleansing agent, such as water.

These and other aspects will become readily apparent from the detailed description which follows.

SUMMARY OF THE INVENTION

In one embodiment, the invention provides an implement and a method for cleaning a surface. In another embodiment, the invention provides a cleaning implement comprising a polymer base material, including an adhesive strength and a cohesive strength, capable of cleaning debris from a surface, an antibacterial agent distributed in the polymer and capable of transfer to a surface for sanitizing and wherein the adhesive strength decreases on exposure to a liquid cleansing agent, the adhesive strength and antibacterial agent capable of being regenerated.

In yet another embodiment, the cleaning implement comprises a polymer base material, wherein a cohesive strength of the polymer is at least five times greater than an adhesive strength of the polymer, an antibacterial agent distributed in the polymer, the antibacterial agent capable of transfer to a surface and wherein the adhesive strength and antibacterial agent are regenerable on exposure to a liquid cleansing agent.

In another embodiment, a method to clean a surface with a cleaning implement is provided, comprising the steps of contacting the implement comprising a polymer and an adhesive strength with a surface, cleaning debris from the surface, transferring an antibacterial agent to the surface, contacting the implement with a cleansing agent to decrease the adhesive strength and remove the debris, and drying the implement and thereby regenerating the adhesive strength and antibacterial agent.

BRIEF DESCRIPTION OF DRAWINGS

The various embodiments of the invention will hereinafter be described in conjunction with the appended drawings provided to illustrate and not to limit the invention, wherein like designations denote like elements, and in which:

FIG. 1 is graph showing the cohesive and adhesive strength of one embodiment of the invention.

DETAILED DESCRIPTION OF THE INVENTION

Figure 2:
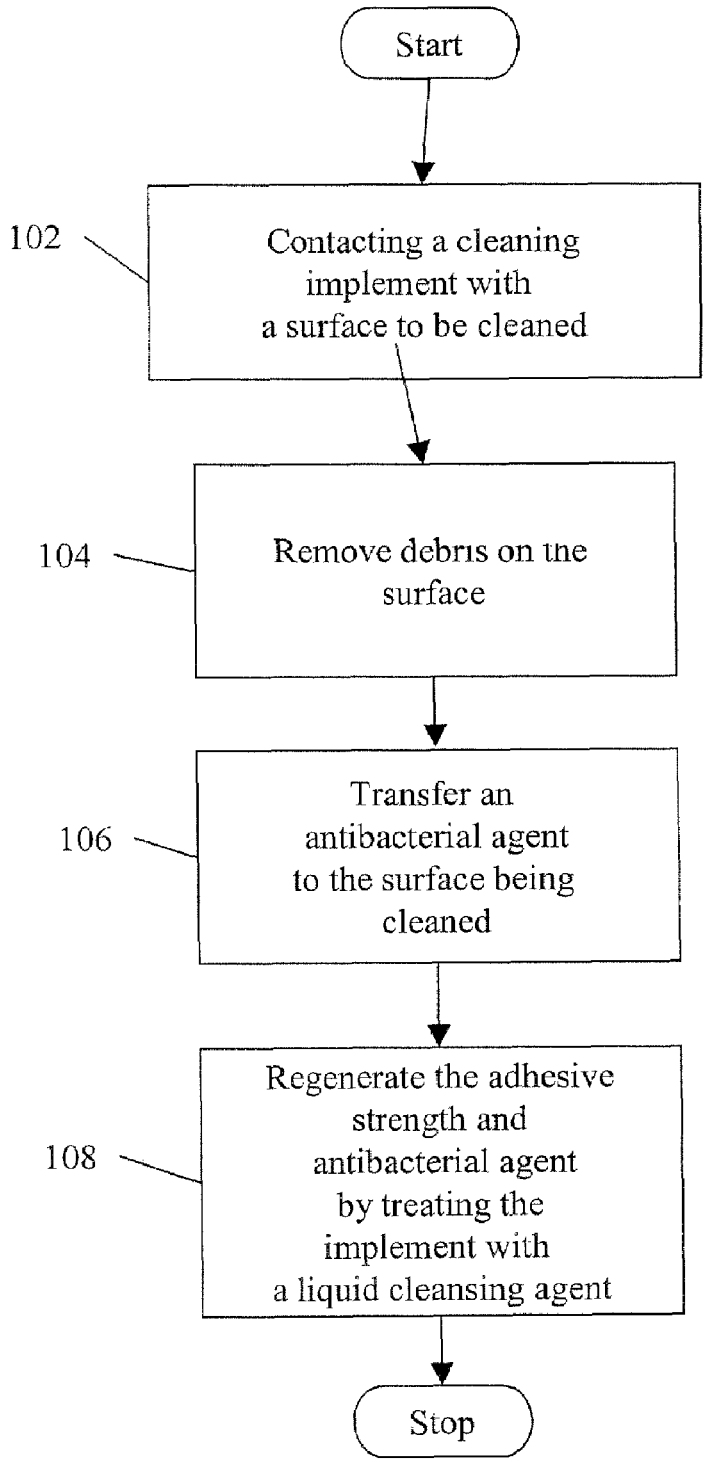
FIG. 2 is a flowchart illustrating steps of a method for using a cleaning implement in accordance with an embodiment of the invention.

Before describing the present invention in detail, it is to be understood that this invention is not limited to particularly exemplified methods or embodiments that may, of course, vary. It is also to be understood that the terminology used herein is for the purpose of describing particular embodiments of the invention only, and is not intended to limit the spirit and scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

Definitions

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, some of the preferred materials and methods are described herein.

"Adhesive Strength" as used herein is the force of attraction between different substances, such as glass and water.

"Antibacterial agent" or "Antimicrobial agent" as used herein are interchangeable and includes agents capable of killing, inhibiting or reducing the growth of any broad spectrum of pathogenic microorganisms such as bacteria, yeast, fungi, algae, viruses, and mold.

"Cleaning" or "to clean" as used herein means removal of debris from a surface.

"Cohesive Strength" as used herein is the force of attraction between molecules of the same substance.

"Debris" as used herein includes any material or object which is desired to be picked up by the cleaning implement. Non limiting examples include material commonly found on floors, carpets and countertops such as lint, dirt, grass, thread, pins, paper clips and scraps of paper, as well as larger pieces of metal, plastic, wood, paper, fabric, glass and in certain applications, objects such as keys, household items, small tools etc. Debris may also be found on the surface of objects requiring cleaning or sanitizing, such as furniture, toys, clothing, appliances, office items and the like.

"Instant Sanitizing" as used herein means the implement of the present invention sanitizes a surface within 30 seconds without the need for soap and water.

"Regenerable" as used herein means that an active property can be regenerated after a use. Thus, the cleaning implement is reusable.

"Sanitize" as used herein means that any of a broad spectrum of pathogenic microorganisms such as bacteria, yeast, fungi, algae, viruses, and mold has been killed, inhibited or reduced.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of".

It must be noted that, as used in this specification and the appended claims, the singular forms "a," "an" and "the" include plural referents unless the content clearly dictates otherwise. Thus, for example, reference to a "surfactant" includes two or more such surfactants.

Base Material Composition

Important properties of the base material of the cleaning implement are quick stick, high tack, and cohesive and adhesive strength. Thus, the base material of the cleaning implement composition has a cohesive strength and an adhesive strength. FIG. 1 shows one embodiment of the cohesive and adhesive strength of a base polymer material used in the present invention. Accordingly, the cohesive strength is at least five times greater than the adhesive strength of the base material. The adhesive strength decreases on exposure to a liquid cleansing agent. Preferably, the adhesive strength decreases at least 10% on exposure to a liquid cleansing agent.

In one embodiment of the invention, the base material is any suitable polymer material including pressure sensitive adhesives (PSA's), adhesive polymers, tacky polymers or combinations thereof. In another embodiment, the material is an elastomeric amorphous polymer, wherein the elastomeric amorphous polymer can be a thermosetting elastomer or a thermoplastic elastomer.

Thermosetting elastomers or thermosets refer to a variety of polymer materials that can be cured to a stronger form through addition of energy and/or catalysts. The curing process transforms the polymer into a plastic or rubber by cross-linking. The addition of energy and catalysts causes the molecular chains in the polymer to link into a rigid, 3-D structure. The energy may be in the form of heat (generally above 200 degrees Celsius), through a chemical reaction (e.g., two-part epoxy), or an irradiation. However, other known modes in the art of providing energy may be used in the curing process. A thermosetting material cannot be melted and re-molded after it is cured.

Thermosetting materials are usually liquid, powder, or malleable prior to curing, and designed to be molded into their final form. They may also be used as adhesives. Examples of thermosetting elastomers include, but are not limited to, vulcanized rubber, bakelite, duroplast, urea-formaldehyde foam, melamine, polyester resin, and epoxy resin and combinations thereof.

Thermoplastic elastomers refer to a variety of polymer materials that can be melted and re-formed or "recycled". In one embodiment, thermoplastic elastomers have an A-B-A block copolymer structure in which the A block is a hard segment and the B block is a soft or elastomeric segment. Examples of hard segment A includes, but are not limited to, polystyrene, poly (alpha-methylstyrene), polyethylene, polyurethane, polyester, and polycarbonate. Examples of soft or elastomeric segment B includes, but are not limited to, polybutadiene, polyisoprene, poly(ethylene-co-butylene), polydimethylsiloxane, polyester, polyether, and EPDM. Examples of thermoplastic elastomers include, but are not limited to, ethylene vinyl acetate (EVA), amorphous poly alpha olefin (APAO), poly (styrene-b-elastomer-b-styrene) block copolymers such as styrene/butadiene A-B-A block copolymer (SBS), styrene/isoprene A-B-A block copolymer (SIS), and styrene ethylene-butylene A-B-A block copolymer (SEBS), propylene ethylene-propylene block copolymer, thermoplastic polyurethane elastomers, and thermoplastic polyester elastomers.

In one embodiment, a suitable thermoplastic comprises functional groups that can be converted to thermoset polymers by adding a curing agent (applicable to the functional groups within the polymer. Monomeric species, which generate the polymeric species, would be interchangeable for thermoset/thermoplastic processes, if the appropriate crosslinkers, curing agents, and the like were incorporated during the synthesis of the polymeric species.

The base is selected to provide the desired washable, tacky characteristics of the implement composition and can be modified as desired. In one embodiment, the polymer has adhesive strength from about 0.3 lb/f to about 0.5 lb/f when the implement is clean and dry. The adhesive properties can be regenerated to that of the clean and dry implement upon contact with a cleansing agent. Optionally, the implement may need sufficient time to dry in order to regenerate the adhesive properties.

Preferred materials include block copolymer (SIS), A-B-A elastomeric block copolymers such as high molecular weight styrene-ethylene-butylene-styrene (SEBS) (sold as Kraton G-1651 by the Shell Chemical Co.) and hot melt adhesives (sold as DERMA-TAK® by National Starch and Chemical Company (New Jersey, USA).

Antibacterial Agents

In one embodiment, the antimicrobial agent is dispersed homogeneously throughout the polymeric composition. In another embodiment, the antimicrobial agent is bound or entrained within the polymeric composition. Non-limiting examples of antimicrobial agents include:

Acids: Include effective organic and inorganic acids known in the art, including, but not limited to: citric acid, cresylic acid, dodecylbenzene sulfonic acid, phosphoric acid, salicylic acid, sorbic acid, sulfamic acid, acetic acid, benzoic acid, boric acid, capric acid, caproic acid, cyanuric acid, dihydroacetic acid, dimethylsulfamic acid, propionic acid, polyacrylic acid, 2-ethyl-hexanoic acid, formic acid, fumaric acid, 1-glutamic acid, isopropyl sulfamic acid, naphthenic acid, oxalic acid, phosphorus acid, valeric acid, benzene sulfonic acid, xylene sulfonic acid, as well as any acid listed as a registered pesticide active ingredient with the United States Environmental Protection Agency. Further useful acids include: sulfonic acids, maleic acid, acetic acid, adipic acid, lactic acid, butyric acid, gluconic acid, malic acid, tartaric acid, as well as glycolic acid. Desirably glycolic acid and citric acid are used as they are effective and in plentiful supply.

Alcohols: Ethanol, isopropanol, n-propanol

Biguanides: polyhexamehtylene biguanide (PHMB), chlorhexadine gluconate (CHG)

Chitosan

Hypohalous Acid and Salts: Hypohalite, defined as hypohalous acid and/or salts thereof. Suitable hypohalous acids and salts may be provided by a variety of sources, including compositions that lead to the formation of positive halide ions and/or hypohalite ions, as well as compositions that are organic based sources of halides, such as chloroisocyanurates, haloamines, haloimines, haloimides and haloamides, or mixtures thereof. These compositions may also produce hypohalous acid or hypohalite species in situ. Suitable hypohalous acids and salts for use herein include the alkali metal and alkaline earth metal hypochlorites, hypobromites, hypoiodites, chlorinated trisodium phosphate dodecahydrates, potassium and sodium dichloroisocyanurates, potassium and sodium trichlorocyanurates, N-chloroimides, N-chloroamides, N-chlorosulfamide, N-chloroamines, chlorohydantoins such as dichlorodimethyl hydantoin and chlorobromo dimethylhydantoin, bromo-compounds corresponding to the chloro-compounds above, and compositions which generate the corresponding hypohalous acids, or mixtures thereof.

Inorganic oxides/hydroxides: Insoluble inorganic oxides with isoelectric points greater than the pH of the solution has been shown to be very efficient at the physical removal of microorganisms (bacteria and virus). Such compounds include magnesium hydroxide, calcium hydroxide, magnesium oxide, aluminum oxide, iron oxide, cerium oxide, zinc oxide, zirconium oxide, barium oxide, calcium oxide, hydroxyapatite, chromium oxide, cobalt oxide, cesium oxide, and chrysotile asbestos. The antimicrobial capability of these materials can be improved by the doping of antimicrobial metals such as silver and the other metals listed above. These metals can also be doped into other inorganic oxides such as silicates for antimicrobial action.

Metals: Additional antimicrobial agents are antibacterial metal salts. This class generally includes salts of metals in groups 3b-7b, 8 and 3a-5a. Specifically are the salts of aluminum, zirconium, zinc, silver, gold, copper, lanthanum, tin, mercury, bismuth, selenium, strontium, scandium, yttrium, cerium, praseodymiun, neodymium, promethum, samarium, europium, gadolinium, terbium, dysprosium, holmium, erbium, thulium, ytterbium, lutetium and mixtures thereof.

Naturals: Also useful as antimicrobial agents are the so-called "natural" antibacterial actives, referred to as natural essential oils. These actives derive their names from their natural occurrence in plants. Typical natural essential oil antibacterial actives include oils of anise, lemon, orange, rosemary, wintergreen, thyme, lavender, cloves, hops, tea tree, citronella, wheat, barley, lemongrass, cedar leaf, cedarwood, cinnamon, fleagrass, geranium, sandalwood, violet, cranberry, eucalyptus, vervain, peppermint, gum benzoin, basil, fennel, fir, balsam, menthol, ocmea origanum, *Hydastis carradensis*, Berberidaceae daceae, Ratanhiae and *Curcuma longa*. Also included in this class of natural essential oils are the key chemical components of the plant oils which have been found to provide the antimicrobial benefit. These chemicals include, but are not limited to anethol, catechole, camphene, carvacol, eugenol, eucalyptol, ferulic acid, farnesol, hinokitiol, tropolone, limonene, menthol, methyl salicylate, thymol, terpineol, verbenone, berberine, ratanhiae extract, caryophellene oxide, citronellic acid, curcumin, nerolidol and geraniol.

Phenols: Triclosan®, Parachlorometaxylenol (PCMX)

Quats: Quats: these quaternary compounds include benzalkonium chlorides and/or substituted benzalkonium chlorides, di($C_6$-$C_{14}$)alkyl di short chain ($C_{1-4}$ alkyl and/or hydroxyalkl) quaternaryammonium salts, N-(3-chloroallyl) hexaminium chlorides, benzethonium chloride, methylbenzethonium chloride, and cetylpyridinium chloride. Other quaternary compounds include the group consisting of dialkyldimethyl ammonium chlorides, alkyl dimethylbenzylammonium chlorides, dialkylmethylbenzylammonium chlorides, and mixtures thereof. Biguanide antimicrobial actives including, but not limited to polyhexamethylene biguanide hydrochloride, p-chlorophenyl biguanide; 4-chlorobenzhydryl biguanide, halogenated hexidine such as, but not limited to, chlorhexidine (1,1'-hexamethylene -bis-5-(4-chlorophenyl biguanide) and its salts are also in this class.

Preferred antimicrobial agents include natural antibacterial actives, such as tea tree oil, lemon oil, mint oil, available from Firemenich, Lactic Acid, available from PURAC; d-limonene available from Millennium Specialty Chemicals; quaternary ammonium compounds available from Lonza; silver di-hydrogen citrate available from Ciba Specialty Chemicals and mixtures thereof.

The antimicrobial agents useful in the present invention can be present from about 0.01% to about 20% weight, and preferably from about 5% to about 10% weight. The level is selected to provide the desired level of antimicrobial activity and can be modified as desired.

Surfactants

The surfactant may function to increase the water washability of the implement. A surfactant is a water soluble or water dispersible nonionic, anionic, cationic, or an amphoteric compound with emulsifying abilities and may be any conventional surfactant known to the art. A representative listing of surfactants and properties thereof is detailed in Remington's Pharmaceutical Sciences, 17$^{th}$ edition (Mack Publishing Company).

The amount of surfactant added will influence the stability of the composition and the adhesive forces. Excessive amounts of surfactants tend to make the resulting adhesive composition wet and weaken its adhesive force. On the other hand, too little surfactant tends to easily cause phase separation and affect the stability of the adhesive composition. Thus, the level is selected to provide the desired level of adhesive strength and can be modified as desired.

Plasticizing Oils

The plasticizing oil may be incorporated to increase flexibility, workability or extensibility of the implement composition. Both water soluble or water insoluble plasticizers can be present in an embodiment of the present invention, either alone or in any desired combination. Non-limiting examples include napthenic oil, paraffinic oil, hydrocarbon oils, olefin oligomers, low molecular weight polymers and animal and vegetable (natural or synthetic) oils. The level is selected to provide the desired characteristics and can be modified as desired.

Fragrance

In one aspect, the fragrance (natural or synthetic) may be incorporated as a separate component or the fragrance may be present as a result of the plasticizing oil. In another aspect, the fragrance is used as an aesthetic fragrant enhancement.

A non-limiting example includes lavender oil which is fragrant, serves as a plasticizer, and has antimicrobial efficacy.

Indicators

In one aspect, an indicator provides a clear and obvious visual or physical indication to the user that the antimicrobial agent is working, has been depleted, is no longer working or that the implement is overloaded with microorganisms. In another aspect, the indicator is used as an aesthetic enhancement.

In one embodiment, the indicator is dispersed homogeneously throughout the object. In another embodiment, the indicator is bound or entrained within the object. In another embodiment, the indicator is encapsulated.

In another embodiment, the indicator is a physical degradation of the implement. Degradation may be based on the incorporation of a material, which breaks down over a specified period of time. A non-limiting example includes Polyvinyl alcohol (PVOH) crosslinked with sodium tetraborate in an aqueous solution. When the PVOH dries out, the composition falls apart or degrades.

In another embodiment, the implement loses its adhesive properties indicating that the antimicrobial is depleted.

In yet another embodiment the indicator is a visual color change experience. In one aspect the color change is based on a change in pH. In another aspect, the color change is based on an indicator dye, capable of generating a visible color change within a relevant pH range or reducing environment. Examples of relevant pH change indicator dyes are listed in Table 1 below.

TABLE 1 pH Change Indicators

| Range of visible color change | Indicator | Color acidic | Color basic |
|---|---|---|---|
| 0.2-1.8 | Cresol red | Red | Yellow |
| 1.2-2.8 | m-Cresol purple | Red | Yellow |
| 1.2-2.8 | Thymol blue | Red | Yellow |
| 2.0-4.4 | 2,6-Dinitrophenol | Colorless | Yellow |
| 2.8-4.7 | 2,4-Dinitrophenol | Colorless | Yellow |
| 2.9-4.0 | 4-Dimethyl aminoazobenzene | Red | Orange |
| 3.0-4.6 | Bromophenol blue | Yellow | Purple |
| 3.0-5.2 | Congo red | Blue | Red |
| 3.1-4.4 | Methyl Orange | Red | Yellow |
| 3.5-5.5 | Ethoxychrysodine hydrochloride | Red | Yellow |
| 3.6-5.4 | Bromocresol green | Yellow | Blue |
| 4.0-5.8 | 2,5-Dinitrophenol | Colorless | Yellow |
| 4.4-6.2 | Methylene red | Red | Yellow |
| 4.8-6.4 | Chlorphenol red | Yellow | Purple |
| 5.2-6.8 | Bromocresol purple | Yellow | Purple |
| 5.4-7.5 | 4-Nitrophenol | Colorless | Yellow |
| 5.7-7.4 | Bromoxylenol blue | Yellow | Blue |
| 6.0-7.6 | Bromothymol blue | Yellow | Blue |
| 6.4-8.2 | Phenol red | Yellow | Red |
| 6.6-8.6 | 3-Nitrophenol | Colorless | Orange |
| 6.8-8.0 | Neutral red | Bluish red | Orange |
| 7.0-8.8 | Cresol red | Yellow | Purple |
| 7.3-8.7 | 1-Napthol phthalein | Brown | Blue |
| 7.4-9.0 | m-Cresol purple | Yellow | Purple |
| 8.0-9.6 | Thymol blue | Yellow | Blue |
| 8.2-9.8 | Phenolphthalein | Colorless | Violet |
| 9.3-10.5 | Thymolphthalein | Colorless | Blue |
| 10.0-12.1 | Alizarin yellow | Yellow | Brownish yellow |
| 11.6-13.0 | Epsilon blue | Orange | Violet |

In another embodiment, the pH color change indicator is an Anthocyanin, which is a water soluble vacuolar flavonoid pigment that reflects in the red to blue range of the visible spectrum depending on the pH of the surrounding solution. An Anthocyanin appears red in acidic solutions and blue in bases.

In another embodiment, color change is based on pressure or temperature, such as a thermo-chromatic change.

In another embodiment, the color change is based on oxidation-reduction reactions. A non-limiting example of an oxidation-reduction indicator includes Resazurin (Alamar Blue), which is colorless in a reduced state and pink in an oxidized state.

Other known methods of color change known in the art may be employed accordingly.

Liquid Cleansing Agents

Liquid agents may be aqueous (water borne) or non-aqueous (solvent borne) fluids. Non-limiting examples would be water, surfactants containing water, surfactants not containing water (flow at room temperature), acids, bases, alcohols, oils, linear alkanes (pentane), cyclics (hexane), aromatics (benzene), substituted aromatics (toluene) and combinations thereof. In one embodiment, the implement would be cleansed with any liquid agent and subsequently rinsed with water. In a preferred embodiment, the implement would be cleansed with water or a surfactant containing water.

Alternative Embodiments

In each of the following embodiments, the antimicrobial sticky polymer facilitates pickup of debris. Optionally, the antimicrobial agent is delivered to the surface being cleaned. The adhesive and antimicrobial properties are regenerable upon contact with a liquid cleansing agent.

In one embodiment, the cleaning implement if formed throughout of the same material, for example, it is a ball or solid cube.

In another embodiment of the present invention, the cleaning implement is attached to a base. The base may be rigid or flexible. Non-limiting examples of a base are textiles (woven and non-woven), handles, strings, eraser pads, films, foils, fabrics, plastics, papers, woods, metals, alloys and the like.

In yet another embodiment of the present invention, the cleaning implement is a non-woven article, wherein the non-woven comprises at least two surfaces. The at least two surfaces of the non-woven cleaning article are hereafter referred to as the first surface and the second surface. The first surface of the cleaning article comprises a tacky continuous layer that intermingles with non-woven fibers such that it allows a strong permanent bond on a non-woven fiber interface. The second surface of the cleaning article has a reversible tacky surface attached non-permanently to it with enough binding force such that the article can be used as a non-woven cleaning article. The process by which the tacky continues layer is incorporated onto the first surface of the cleaning implement, requires the tacky continuous layer to be of a thickness that allows permanent attachment and structural integrity of the non-woven cleaning article. The temperature range used to form the tacky continuous layer is controlled to create a low viscosity, low surface tension liquid that flows and coats the non-woven fibers and cools at a rate that is enough to keep the penetration depth controlled in relation to the liquid permeability of the non-woven cleaning implement. This, thus, creates the tacky continuous layer having a non-permanent attachment to the second surface of the non-woven cleaning article.

In another embodiment of the present invention, the cleaning implement is a hand ball. In one another embodiment, the ball is made throughout of a base polymeric material as described herein. In yet another embodiment, the core of the hand ball may be made of a tacky base material, while the surface of the ball can be of a fabric or elastic covering. The ball can optionally contain antibacterial agents that are controllably released upon manipulation or compression, thereby sanitizing a surface. In another embodiment, the antimicrobial agent is added to the interior of the hand ball. The antimicrobial agent is contained in a semi-permeable elastic membrane inside the hand ball. The semi-permeable elastic membrane controls diffusion of the antibacterial agent out of the ball by the action of compressing or manipulating the ball. The antimicrobial agent can be a liquid, a solid that sublimes or dissolves, or a combination of the two.

In another embodiment of the present invention, the cleaning implement is a sweep broom. In one aspect, the antimicrobial sticky polymer is applied to at least one surface of the broom bristles. In another aspect, the antimicrobial sticky polymer is applied to a substrate, such as a nonwoven, which is attached to at least one surface of a broom head. The sweep broom is used for sweeping up debris in an ordinary fashion. To clean up debris accumulated after sweeping and to sanitize a surface, the adhesive applied surface of the sweep broom is contacted with the debris and the debris is "picked up" by the broom. The debris is removed from the sweep broom bristles or substrate by either disposing of the substrate or washing the debris from the substrate or bristles with a liquid cleansing agent to regenerate the antimicroibal and adhesive properties.

In yet another embodiment of the present invention, the cleaning implement is a sponge shaped implement coated on one side with an abrasive and an antimicrobial sticky polymer on the other side. The sponge-like implement may or may not be disposable In yet another embodiment of the present invention, the cleaning implement is a glove or a shoe/foot attachment.

In yet another embodiment of the present invention, the cleaning implement is a film of antimicrobial and sticky polymer. The film may or may not be disposable. The film can be placed on, for example, fan blades or on surfaces that come in contact with moving air, including an air filter inside a vacuum, an air ionizer, a humidifier, or the like. When microbes or allergens adhere to the film, the film is self-sanitizing by the antimicrobial agents on the film.

In yet another embodiment of the present invention, the cleaning implement is a disposable covering for ergonomic devices. The disposable covering comprises antimicrobial and sticky polymer. Examples of such ergonomic devices include, but are not limited to, a cover for a wrist rest on a personal computer, an office chair armrest, an airplane chair armrest, or any surface considered a "high touch" area or a "hot zone" for microorganisms. The tack properties of the adhesive used in the disposable covering of the ergonomic devices can be tailored. In one aspect, less plasticizing oils can be incorporated to make the polymer more rigid with applications for less tacky uses.

In yet another embodiment of the present invention, the cleaning implement is a general purpose duster for cleaning window blinds and larger surfaces to which dust, allergens, microorganisms, and the like, adhere to.

In yet another embodiment of the present invention, the cleaning implement is shaped similar to a spatula/blade tool. The spatula/blade may have large surface area or a small surface area, or a combination thereof.

In yet another embodiment of the present invention, the cleaning implement is a toy, such as Wacky Wall Walker®, building blocks, or other soft rubber-like articles, which maintain their overall geometry and sanitize surfaces they come in contact with while in use.

In yet another embodiment of the present invention, the cleaning implement is an eraser type tool for removal of residues and soils (e.g. pencil markings, scuffs on floor, and the like). The eraser type implement does not erode, degrade, crumble, or leave behind any particulate residue. The eraser-like implement may or may not be disposable.

Methods of Using the Cleaning Implement

The polymeric base material used in the cleaning implement is well known in the art and it is optionally blended with further components (e.g., plasticizing oils and tackifiers) to achieve the degree of deformability, stick and tackiness according to the debris to be picked up.

A method to clean a surface with a cleaning implement, comprising the steps of contacting the implement comprising a polymer and an adhesive strength with a surface, cleaning debris from the surface, transferring an antibacterial agent to the surface, contacting the implement with a cleansing agent to decrease the adhesive strength and remove the debris, and drying the implement and thereby regenerating the adhesive strength and antibacterial agent.

Treatment of the cleaning implement with a liquid cleaning agent causes the antibacterial agents incorporated in the tacky polymer material to move up to the surface of the polymer, thus causing the antibacterial agents to be regenerated. The regeneration of the antibacterial agents may be performed when the antibacterial agents are transferred onto the surface being cleaned. Alternatively, the regeneration of the antibacterial agents may be performed by exposing it to a cleansing agent after sanitizing.

Treatment of the cleaning implement with a liquid cleaning agent causes the adhesive strength of the tacky polymer material to decrease, preferably by about 10%. Thereby, the debris picked up during the cleaning process is released from the implement. In one embodiment, the adhesive properties are regenerated after the implement is dry.

In an alternative embodiment, the cleaning implement can be used to sanitize a surface when no debris is present.

FIG. 2 is a flowchart illustrating steps of a method for using a cleaning Implement. At step 102, the cleaning implement is applied to a surface. The cleaning implement comprises a tacky polymer material and an antibacterial agent. At step 104, debris on the surface is removed using the implement. At step 106, the antibacterial agent is transferred onto a surface. At step 108, the sticky polymer material and the antibacterial agents are regenerated on contact with a liquid cleansing agent.

In another embodiment of the present invention, the above mentioned method can also include a step of drying the cleaning implement before reusing it.

EXAMPLES

Example 1

Preparation of a Sanitizing Cleaning Implement using Lactic Acid

A sanitizing cleaning implement is prepared including 12.37 g National Starch Polymer (34-154A lot 9033022) (Bridgewater, N.J., USA) and 1.37 g Lactic Acid as the antimicrobial agent. The National Starch Polymer was added to a beaker and heated in an oven to about 190° C., a pourable state. A mixing beaker with a 2" vessel diameter and 1" impeller diameter was preheated to 200° C. using a wrapped heating pad. The heated polymer was weighed using loss in weight method from the oven heated beaker and added to the mixing beaker. The antimicrobial agent was weighed using loss in weight method from source active liquid bottle and added to the mixing beaker. The mixture was then stirred for about 5 minutes or until the temperature drops to 76.6° C. The mixture can be formed for use by itself or applied to a suitable base. The mixture should be cooled to ambient temperature before use.

Example 2

Preparation of Sanitizing Cleaning Implement Polymer using Lavender Oil

A sanitizing cleaning implement is prepared including 65.0 g National Starch Polymer (34-154A) (Bridgewater, N.J., USA) and 12.0 g Lavender Oil as the antimicrobial agent. A mixing beaker was prepared with a 2" vessel diameter and 1" impeller diameter. The National Starch Polymer was measured into the beaker. 100 g of toluene were added and the polymer was dissolved by stirring for 120 minutes. The antimicrobial agent was weighed using loss in weight method from source active liquid bottle and added to the mixing beaker. The mixture was then stirred for about 10 minutes. The solvent was allowed to evaporate off at ambient conditions (alternatively under negative pressure i.e., vacuum) in a hood for about 2 hours or until the desired viscosity was achieved (e.g. film casting parameters—viscosity influences film thickness). The mixture can be formed for use by itself or applied to a suitable base.

Example 3

Preparation of Sanitizing Cleaning Implement Polymer using Mint Oil; Lemon Oil; and Tea Tree Oil Three further compositions were prepared with a ratio of 99% National Starch Polymer (34-154A) to 1% antimicrobial agent of Mint, Lemon Oil or Tea Tree Oil by the method described in Example 2.

Example 4

Cohesive and Adhesive Strength of Cleaning Implement

The cohesive and adhesive strength of a sticky polymer, National Starch Polymer (34-154A) was tested. The study method included the following steps:

A 1 ft×1 ft sheet of Mylar was taped down to a countertop. National Starch Polymer was heated for 45 minutes in an oven 190° C. The heated Polymer was poured in a line across the Mylar sheet and quickly spread evenly with a draw knife. The coating was about 0.3 cm to about 1.0 cm thick. After a few minutes of cooling, masking tape was laid down to create sample sizes about 1 in.×3 in. A second 1 ft×1 ft sheet of Mylar was placed over the first sheet (now coated with Polymer). The samples were cut apart. An additional glass pane was placed on top of the samples with 250 g of weight compression and pressed down on for about 5 seconds. The adhesive force was measured according to a standard lamination peel strength test according to ASTM 2737M, gauge length of 1 inch, bond strength of 5.6, strain rate of 12 in/min as measured on the INSTRON 5565/Q1216 and the results are shown in FIG. 1.

The results show that the adhesive strength is about 0.76 lb/f and the cohesive strength is about 3.64 lb/f. Accordingly, the cohesive strength is about 5 times greater than the adhesive strength.

Example 5

Adhesive Strength Performance Aspects on a Hard Surface

The adhesive strength of a sticky polymer, National Starch Polymer (34-154A lot 9033022), at 5 different points of use on a hard surface was tested. The 5 points of use include: 1) clean and dry; 2) clean and wet; 3) light dirt and dry; 4) heavy dirt and dry; 5) soiled, wet then dry (regenerated).

The study method included the following steps: A 1 ft×1 ft sheet of Mylar was taped down to a countertop. National Starch Polymer was heated for 45 minutes in an oven 190° C. The heated Polymer was poured in a line across the Mylar sheet and quickly spread evenly with a draw knife. The coating was about 0.12 in. to about 0.4 in. thick. After a few minutes of cooling, masking tape was laid down to create sample sizes about 1 in.×3 in. A second 1 ft×1 ft sheet of Mylar was placed over the first sheet (coated with Polymer), excluding the top row. The samples were cut out and separated into 3 test groups of 5 slides. If necessary, the Mylar sheets were removed from the sample. The slides were prepared according to the conditions presented in Table 2. Then, the top sheet of Mylar was replaced and an additional glass pane was placed on top with 250 g of weight compression and pressed down on for about 5 seconds. The adhesive force was measured and the results are shown in Table 2.

TABLE 2

Adhesive Strength at 5 Points of Use

| Test | Condition | Strength (lb/f) |
|---|---|---|
| 1 | Clean and dry | 0.45 |
| | | 0.42 |
| | | 0.31 |
| 2 | Clean and wet | 0.59 |
| | | 0.39 |
| | | 0.96 |
| 3 | Light dirt and Dry | 0.33 |
| | | 0.58 |
| | | 0.28 |
| 4 | Heavy dirt and dry | 0.05 |
| | | 0.02 |
| | | 0.02 |
| 5 | Light dirt, wet, then dried (regenerated) | 0.45 |
| | | 0.40 |
| | | 0.49 |

Key to Conditions:

Clean and Dry as used herein means no debris or cleansing agent was applied.

Clean and wet as used herein means no debris was applied, but implement was run under water for about 3 seconds before the top piece of Mylar and glass were applied as described. Atypical results due to not enough cleansing agent applied.

Light dirt and dry as used herein means a thin layer of dirt was sprinkled evenly to create a light coating. Then the top piece of Mylar and glass were applied as described. Atypical results due to not enough dirt applied.

Heavy dirt and dry as used herein means a thick layer of dirt was sprinkled evenly to create a light coating. Then the top piece of Mylar and glass were applied as described.

Dirt, wet, then dry as used herein means a thin layer was prepared as descried above, then the implement was rinsed thoroughly under running water. The sample was allowed to dry, then the top piece of Mylar and glass were applied as described.

We claim:

1. A method to clean a surface with a cleaning implement, comprising the steps of:

a. contacting the implement comprising a polymer having an adhesive strength with a surface;

b. cleaning debris from the surface;

c. transferring an antibacterial agent to the surface;

d. contacting the implement with a cleansing agent to decrease the adhesive strength and remove the debris; and e. drying the implement and thereby regenerating the adhesive strength and antibacterial agent.

2. The method of claim 1 further comprising the step of sanitizing the surface.

3. The method of claim 1 wherein the polymer has a cohesive strength and the cohesive strength of the polymer is at least five times greater than the adhesive strength of the polymer.

4. The method of claim 1 wherein the adhesive strength ranges from about 0.3 lb/f to about 0.5 lb/f by the method described herein when the polymer is clean and dry.

5. The method of claim 1 wherein the polymer is a tacky elastomeric polymer plasticized by the antibacterial agent, which is an organic liquid.

6. The method of claim 5 wherein the liquid antibacterial is a natural essential oil.

7. The method of claim 1, wherein the antibacterial is a natural essential oil.

8. The method of claim 1 wherein the antibacterial agent is present in an amount of about 0.01% to about 20% weight.

9. The method of claim 1 wherein the antibacterial agent is homogenously distributed within the polymer.

10. The method of claim 1 wherein the polymer further comprises a plasticizing oil and optionally a tackifier.

11. The method of claim 1 wherein the polymer further comprises a surfactant.

12. The method of claim 1 wherein the liquid cleansing agent is selected from the group consisting of water and a surfactant containing water.

13. The method of claim 1 wherein the implement is attached to a base.

14. The method of claim 13 wherein the base is a nonwoven.

15. The method of claim 1, wherein the cleaning implement releases the antibacterial agent upon compression.

* * * * *